US010287849B2

(12) United States Patent
Nedwed et al.

(10) Patent No.: US 10,287,849 B2
(45) Date of Patent: May 14, 2019

(54) SUBSEA WELL CONTROL SYSTEM

(71) Applicants: Timothy J. Nedwed, Houston, TX (US); William R. Meeks, The Woodlands, TX (US)

(72) Inventors: Timothy J. Nedwed, Houston, TX (US); William R. Meeks, The Woodlands, TX (US)

(73) Assignee: ExxonMobil Upstream Resarch Company, Spring, TX (US)

( * ) Notice: Subject to any disclaimer, the term of this patent is extended or adjusted under 35 U.S.C. 154(b) by 0 days.

(21) Appl. No.: 15/235,496

(22) Filed: Aug. 12, 2016

(65) Prior Publication Data

US 2017/0107777 A1 Apr. 20, 2017

Related U.S. Application Data

(60) Provisional application No. 62/243,443, filed on Oct. 19, 2015.

(51) Int. Cl.

| | |
|---|---|
| ***E21B 33/13*** | (2006.01) |
| ***E21B 33/064*** | (2006.01) |
| ***E21B 33/076*** | (2006.01) |

(52) U.S. Cl.

CPC ..... *E21B 33/13* (2013.01); *E21B 33/064* (2013.01); *E21B 33/076* (2013.01)

(58) Field of Classification Search

CPC ..... E21B 33/035; E21B 33/13

See application file for complete search history.

(56) References Cited

U.S. PATENT DOCUMENTS

| | | | | |
|---|---|---|---|---|
| 1,152,392 | A * | 9/1915 | Breitung et al. | E21B 43/24 116/DIG. 18 |
| 2,198,563 | A * | 4/1940 | Robinson, Jr. | C09K 8/05 106/DIG. 4 |
| 2,212,108 | A * | 8/1940 | Zacher | C09K 8/203 166/294 |
| 2,329,878 | A * | 9/1943 | Baruch | C09K 8/05 166/902 |
| 2,922,478 | A * | 1/1960 | Maly | E21B 33/127 166/154 |

(Continued)

FOREIGN PATENT DOCUMENTS

| | | |
|---|---|---|
| EP | 1 060 325 B1 | 12/2000 |
| WO | WO 00/73376 A1 | 12/2000 |

OTHER PUBLICATIONS

Crichlow, "*Kill the Spill*," Jun. 7, 2010, pp. 1-10.

*Primary Examiner* — Matthew R Buck
*Assistant Examiner* — Aaron L Lembo
(74) *Attorney, Agent, or Firm* — ExxonMobil Upstream Research Company—Law Department

(57) ABSTRACT

Systems, apparatus, and methods for controlling a well blowout comprising: a plug-forming agent reservoir comprising a plug-forming agent proximate a wellbore, the plug-forming agent reservoir in selective fluid communication with the wellbore; providing a pressure source capable of pressurizing the plug-forming agent reservoir containing the plug-forming agent to delivery pressure; and selectively introducing the pressurized first plug-forming agent into the wellbore to form a flow-restricting plug within the wellbore. Exemplary plug-forming agents are provided.

32 Claims, 3 Drawing Sheets

(56) References Cited

U.S. PATENT DOCUMENTS

| | | | | |
|---|---|---|---|---|
| 3,100,525 | A * | 8/1963 | Smith | E21B 21/16 166/288 |
| 4,495,999 | A | 1/1985 | Sykora | |
| 4,616,987 | A * | 10/1986 | Boyers | B29C 43/021 249/65 |
| 5,919,739 | A | 7/1999 | Sunde et al. | |
| 6,179,057 | B1 | 1/2001 | Fontana et al. | |
| 6,253,854 | B1 | 7/2001 | Fenton | |
| 6,932,158 | B2 | 8/2005 | Burts, III | |
| 7,108,006 | B2 * | 9/2006 | Armstrong | E21B 33/0355 137/14 |
| 7,544,641 | B2 | 6/2009 | Robertson et al. | |
| 7,717,179 | B2 * | 5/2010 | Rayssiguier | E21B 33/1277 166/187 |
| 7,735,567 | B2 * | 6/2010 | O'Mally | E21B 33/1208 166/179 |
| 8,651,185 | B2 * | 2/2014 | Hermes | E21B 33/02 166/286 |
| 9,010,435 | B2 * | 4/2015 | Matsur | E21B 33/02 166/285 |
| 9,334,707 | B1 * | 5/2016 | Adger, Jr. | E21B 33/127 |
| 9,617,810 | B2 * | 4/2017 | Smith | E21B 21/001 |
| 9,631,459 | B2 * | 4/2017 | Nedwed | E21B 41/0007 |
| 2008/0220991 | A1 | 9/2008 | Slay et al. | |
| 2013/0118756 | A1 * | 5/2013 | Matsur | E21B 33/02 166/363 |
| 2017/0081933 | A1 * | 3/2017 | Nedwed | E21B 33/035 |
| 2017/0081934 | A1 * | 3/2017 | Nedwed | E21B 33/064 |
| 2017/0081945 | A1 * | 3/2017 | Nedwed | E21B 41/0007 |

* cited by examiner

SUBSEA WELL CONTROL SYSTEM

CROSS REFERENCE TO RELATED APPLICATIONS

The application claims the benefit of U.S. Provisional Application No. 62/243,443, filed Oct. 19, 2015, entitled, "Subsea Well Control System," the disclosure of which is incorporated herein by reference in its entirety. The application is related to U.S. patent application Ser. No. 14/861,330 titled "Polymer Plugs for Well Control," filed Sep. 22, 2015, U.S. patent application Ser. No. 14/861,343 titled "Wellbore Dynamic Top Kill," filed Sep. 22, 2015, and U.S. patent application Ser. No. 14/861,347 titled "Wellbore Dynamic Top Kill With Inserted Conduit," filed Sep. 22, 2015, the disclosures of which are incorporated herein by reference in their entireties.

FIELD OF THE DISCLOSURE

The present disclosure is directed generally to apparatus, systems, and methods for well control, such as may be useful in relation to a hydrocarbon well blowout event and more particularly to systems and methods pertaining to an interim intervention operation for an out of control well.

BACKGROUND OF THE DISCLOSURE

Safety and time are of the essence in regaining control of a well experiencing loss of wellbore pressure control. Loss of pressure control and confinement of a well is commonly referred to as a "blowout." Well control pressure management or "intervention" is required to regain pressure control and confine wellbore fluids within the formation and wellbore. Well control intervention is an important concern not only to the oil and gas industry from a safety and operations standpoint, but also with regard to protecting commercial, environmental, and societal interests at large.

Well control intervention systems and methods are generally classified as either conventional or unconventional. Conventional intervention systems are generally used when the well can be shut-in or otherwise contained and controlled by the wellbore hydrostatic head and/or surface pressure control equipment. In contrast, unconventional well control intervention systems are generally used to attempt to regain control of flowing wells that cannot be controlled by the wellbore fluid and/or surface pressure control equipment. Such "blowout" situation may result from failure of downhole equipment, loss of wellbore hydrostatic control, and/or failure of surface pressure-control equipment. In both intervention classifications, the object of regaining well control is to halt the flow of fluids (liquid and gas) from the wellbore, generally referred to as "killing" or "isolating" the well. Unconventional methods are more complex and challenging than conventional methods and frequently require use of multiple attempts and/or methods, often requiring substantial time investment, including sometimes drilling relief wells. Improved methods and systems for unconventional well control intervention are needed.

Unconventional well control intervention methods include "direct" intervention, referring to intervention actions occurring within the wellbore and indirect intervention refers to actions occurring at least partially outside of the flowing wellbore, such as via a relief well. Two known unconventional direct intervention methods include a momentum weighted fluid methods and dynamic weighted fluid methods. Momentum weighted fluid methods rely upon introducing a relatively high density fluid at sufficient rate and velocity, directionally oriented in opposition to the adversely flowing well stream, so as to effect a fluid collision having sufficient momentum that the kill fluid overcomes the adverse momentum of the out of control fluid stream within the wellbore. Such process is commonly referred to as "out running the well." This is often a very difficult process, especially when performed at or near the surface of the wellbore (e.g., "top-weighted fluid").

Dynamic weighted fluid methods are similar to momentum weighted fluid methods except dynamic weighted fluid methods rely upon introduction of the weighted fluid stream into the wellbore at a depth such that hydrostatic and hydrodynamic pressure are combined within the wellbore at the point of introduction of the weighted fluids into the wellbore, thereby exceeding the flowing pressure of the blowout fluid in the wellbore and killing the well. Dynamic weighted fluid interventions are commonly used in relief well and underground blowout operations, but are also implemented directly in wellbores that contain or are provided with a conduit for introducing the weighted fluid into the wellbore relatively deep so as to utilize both hydrostatic and hydrodynamic forces against the flowing fluid.

Need exists for a an additional layer of well control intervention that can be relatively quickly implemented as compared to the other two intervention mechanisms and utilize resources that are either readily available or readily deployable at the interventions site, in order to interrupt the flow of wellbore fluid from the blowout, until a more permanent unconventional solution can be implemented. An efficient response system of equipment, material, and procedures is desired to provide interim well control intervention that at least temporarily impedes and perhaps even temporarily halts the uncontrolled flow of fluids from an out of control wellbore and provides a time cushion until a more permanent solution can be developed and implemented.

SUMMARY OF THE DISCLOSURE

Systems, equipment, and methods are disclosed herein that may be useful for intervention in a wellbore operation experiencing or potentially experiencing a loss of wellbore hydrostatic pressure control, such as a blowout. The disclosed information may enable regaining control of the well or at least mitigating the flow rate of the blowout, perhaps even temporarily halt the uncontrolled fluid flow. The disclosed control system may be relatively quickly implemented as an interim intervention mechanism to restrict or reduce effluent from the wellbore so as to provide a time-cushion until a permanent well control solution can be implemented.

The disclosed intervention system provides full-time stand-by well control systems and methods that may be efficiently adapted to work with existing well control systems or implemented as separate but full-time, permanent well control solution. Additionally, conventional and/or other unconventional well control operations may subsequently or concurrently proceed in due course, even while the presently disclosed system functions to halt or at least constrict the well effluent flowrate in advance of or concurrently with preparation of the permanent or final solution.

A primary aspect of the disclosed technology is introduction of a plug-forming agent into the wellbore throughbore, such as a resin, polymer, or polymer forming composition into the wellbore to create a plug or restriction in the wellbore.

In one aspect, the methods disclosed herein may include systems, apparatus, and methods for controlling a well blowout comprising: providing a first plug-forming agent reservoir comprising a first plug-forming agent proximate a wellbore, the first plug-forming agent reservoir in selective fluid communication with the wellbore; and providing a first pressure source capable of pressurizing the first plug-forming agent reservoir containing the first plug-forming agent to a first-agent delivery pressure.

In another aspect, the disclosed methods may include selectively introducing the pressurized first plug-forming agent into the wellbore to form a flow-restricting plug within the wellbore. The first plug-forming agent with a wellbore blowout fluid to form the flow-restricting plug within the wellbore.

The methods and systems may also include providing a second plug-forming agent reservoir comprising a second plug-forming agent, such as an agent that interacts with or reacts with either the wellbore fluid or the first plug-forming agent, to create the plug within the wellbore. A second pressure source capable of pressurizing the second plug-forming agent reservoir comprising the second plug-forming agent to a second-agent delivery pressure may also be provided.

According to some implementations, the present systems and methods may include the step of pressurizing the first plug-forming agent reservoir comprises at least one of (1) pre-pressurizing the first plug-forming agent reservoir in a stand-by readiness state prior to selectively introducing the first plug-forming agent into the wellbore, and (2) connecting the first-plug forming agent reservoir with a proximately located and selectively actuatable pressurization system (3) and connecting the first plug-forming agent reservoir with a distributed and selectively actuated pressurization system.

According to some implementations, the present systems and methods may include the step of pressurizing the second plug-forming agent reservoir comprises at least one of (1) pre-pressurizing the second plug-forming agent reservoir in a stand-by readiness state prior to selectively introducing the second plug-forming agent into the wellbore, and (2) connecting the second-plug forming agent reservoir with a proximately located and selectively actuatable pressurization system (3) and connecting the second plug-forming agent reservoir with a distributed and selectively actuated pressurization system.

In many applications, the systems and methods may include locating the first and optional second plug-forming agent reservoir on or proximately near a seafloor.

In some aspects, the presently disclosed technology may include at least one of a polymerizable monomer and a polymer as the first plug-forming agent; and at least one of polymerizing and crosslinking the plug-forming agent within the wellbore throughbore to create a barrier to flow of the wellbore blowout fluid through the wellbore throughbore.

In some aspects, the presently disclosed technology may include at least one of a polymerizable polymer or monomer, a crosslinkable polymer, an activatable resin, and fibrous media as the plug-forming agent.

In some aspects, the presently disclosed technology may include at least one of a polymerization catalyst, a crosslinking agent, and a resin-forming catalyst as the second plug forming agent.

In some aspects, the presently disclosed technology may include providing a dicyclopentadiene (DCPD) as a plug-forming agent.

In other aspects, the presently disclosed technology may include providing a siloxane as a plug-forming agent.

The present teaching include an apparatus for performing a wellbore intervention operation to reduce an uncontrolled flow rate of wellbore fluids from a subterranean wellbore, the apparatus comprising: a first plug-forming agent reservoir comprising a first plug-forming agent proximate a wellbore, the first plug-forming agent reservoir selectively in fluid communication with the wellbore and the first plug-forming agent selectively introducible into the wellbore; and a first pressure source capable of pressurizing the first plug-forming agent reservoir containing the first plug-forming agent a first-agent delivery pressure to selectively introduce the first plug-forming agent into the wellbore.

A second plug-forming agent reservoir comprising a second plug-forming agent proximate the wellbore, the second plug-forming agent reservoir selectively in fluid communication with the wellbore and optionally the first plug-forming agent, and a second pressure source capable of pressurizing the second plug-forming agent reservoir comprising the second plug-forming agent to a second-agent delivery pressure to selectively introduce the second plug-forming agent into at least one of the wellbore and the first plug forming agent may also be included.

A weighted fluid aperture may also be provided in the wellbore, the aperture positioned at an upstream location in the wellbore throughbore with respect to the control fluid aperture and with respect to direction of flow of wellbore blowout fluid flowing through the wellbore throughbore, the weighted fluid aperture capable to introduce a weighted fluid and/or the plugging agent into the wellbore throughbore while either a control fluid or a preliminary control fluid is introduced into the wellbore throughbore through the control fluid aperture.

One objective of the presently disclosed technology is creating a pressure drop in the flowing blowout fluid within the primary throughbore by creating hydrodynamic conditions therein that approach the maximum fluid conducting capacity of the primary throughbore, by introducing control fluid and/or a plug-forming agent therein. A corresponding objective of the presently disclosed technology is to introduce a plug-forming agent into the wellbore throughbore to polymerize and/or crosslink therein and form a polymer and/or crosslinked plug or restriction within the wellbore throughbore to increase the pressure drop in the flowing blowout fluid within the primary throughbore, resulting in reduced or halted blowout fluid flow rate through the wellbore throughbore.

Successful implementation of the presently disclosed technology affords an additional method (in addition to the previously known prior art methods) to achieve some measure of control over the blowout fluid in reasonably accessible points of the wellbore conduit, commonly within the wellhead, marine riser, blowout preventer, or in proximity thereto. This additional measure of control may be achieved using readily portable equipment and without requiring introduction of a separate conduit or work string deep into the wellbore or requiring removal of an obstruction or string from therein. Successful implementation of the presently disclosed technology may thus supplement the well control or blowout intervention process, providing readily responsive action plan options and equipment that may afford at least a temporary plugging or constriction on the blowout fluid flow rate until such time as other more permanent methods of well control such as momentum or dynamic kills, cementing, or addition of a capping stack can be subsequently implemented.

DETAILED DESCRIPTION AND BEST MODE OF THE DISCLOSURE

A readily adaptable, additional option or layer of well-control protection for controlling and/or killing a well blowout may further benefit at least the oil and gas energy industry. The presently disclosed technology is believed to provide functional improvements and/or improved range of methodology options over previously available technology. Methods and equipment are disclosed that may be included on a full-time, stand-by basis, as an additional component to the standard well-control equipment packages that may provide effective interim control of blowout fluid flow from a wellbore such that a more permanent well killing operation may be performed subsequently or concurrently therewith. In many embodiments the presently disclosed well control methods may be applied in conjunction with conventional well control options, as well as with subsequent performance of the long-term or "highly dependable" (permanent) kill operation. In some instances, the presently disclosed interim technology may morph seamlessly from a "control" intervention operation into a permanent well killing operation.

Figure 1:
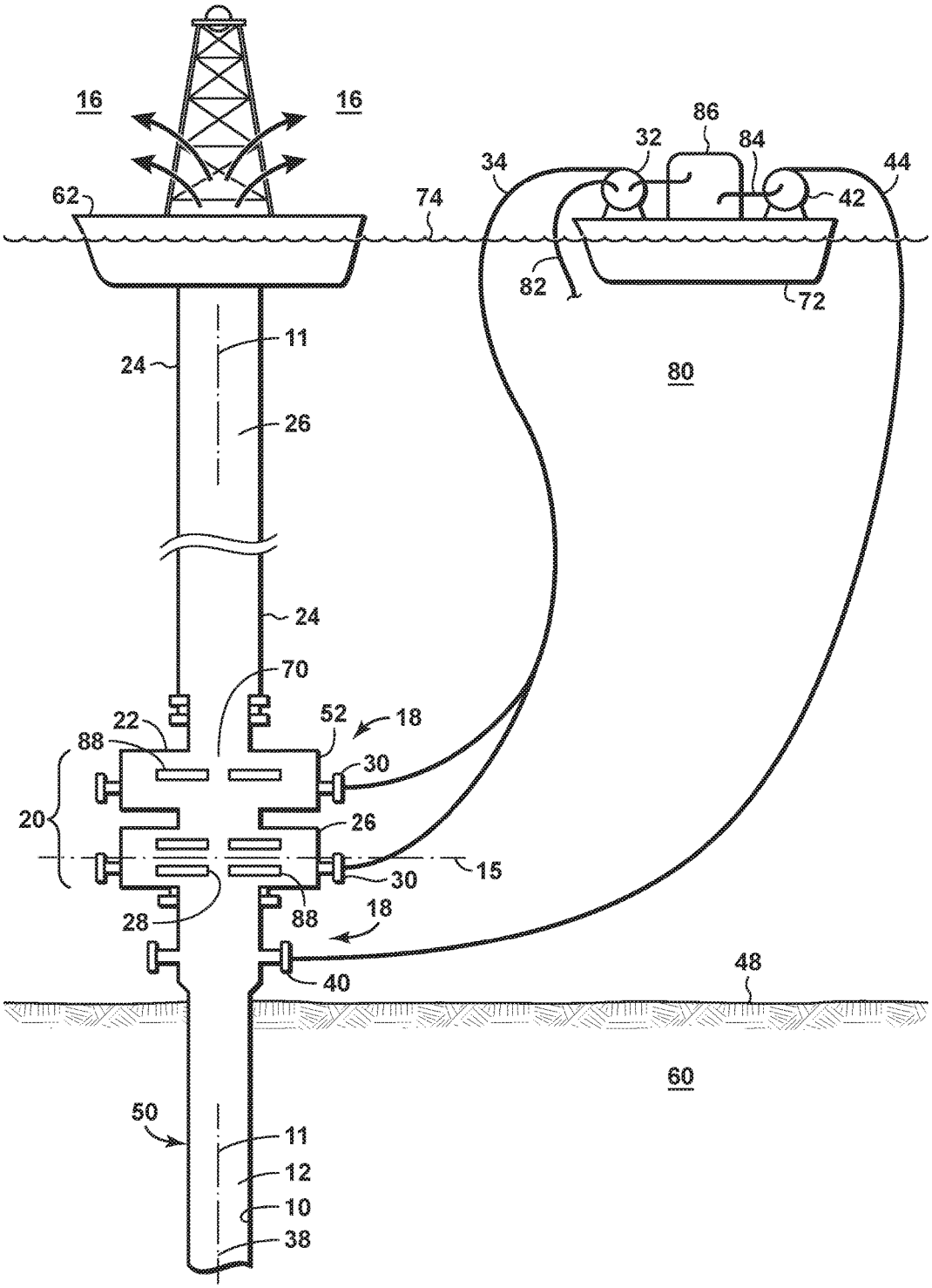
FIG. 1 is an exemplary schematic representation of a well control operation according to the present disclosure.
Figure 2:
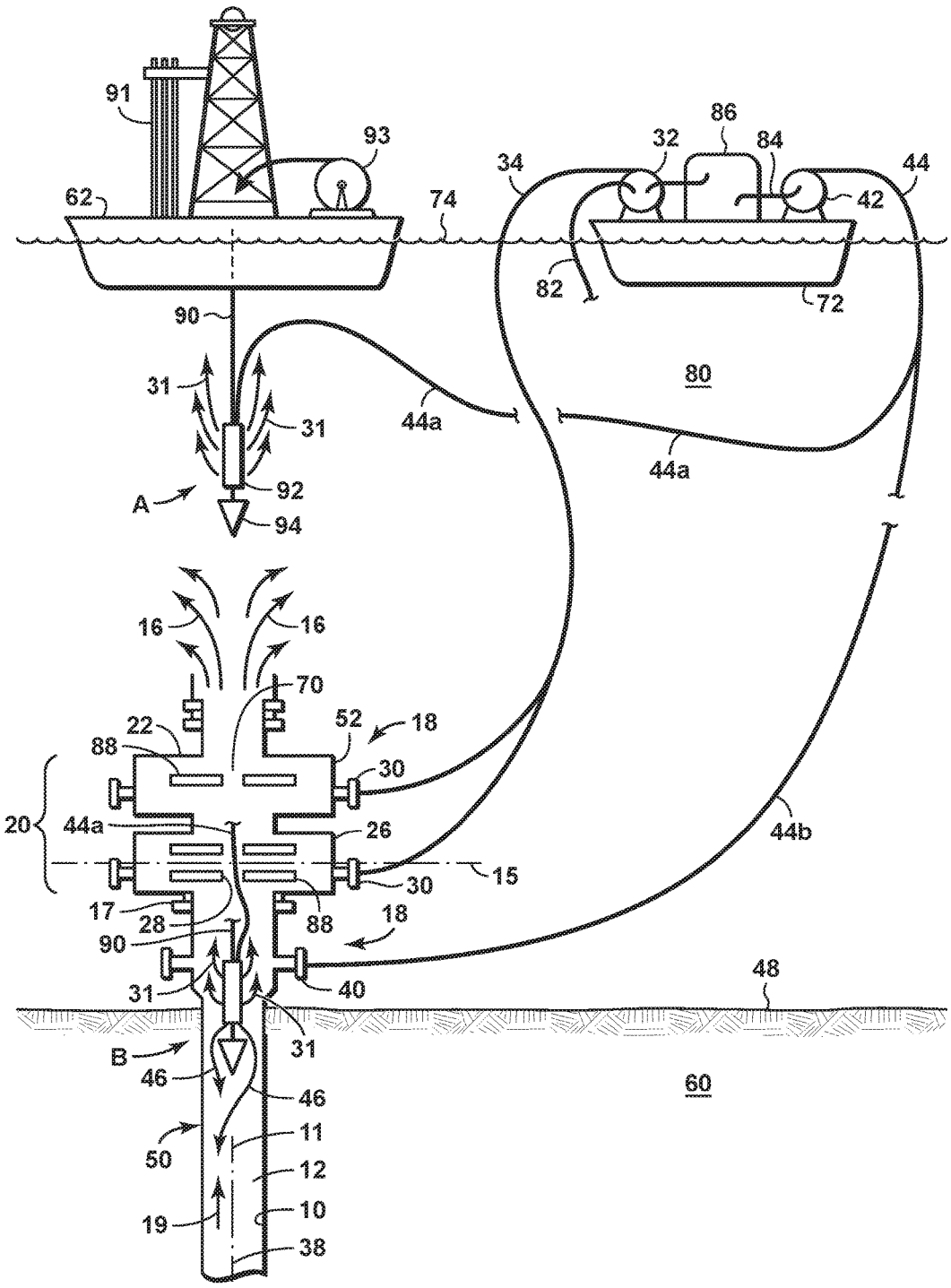
FIG. 2 is also an exemplary schematic representation of a well control operation according to the present disclosure.
Figure 3:
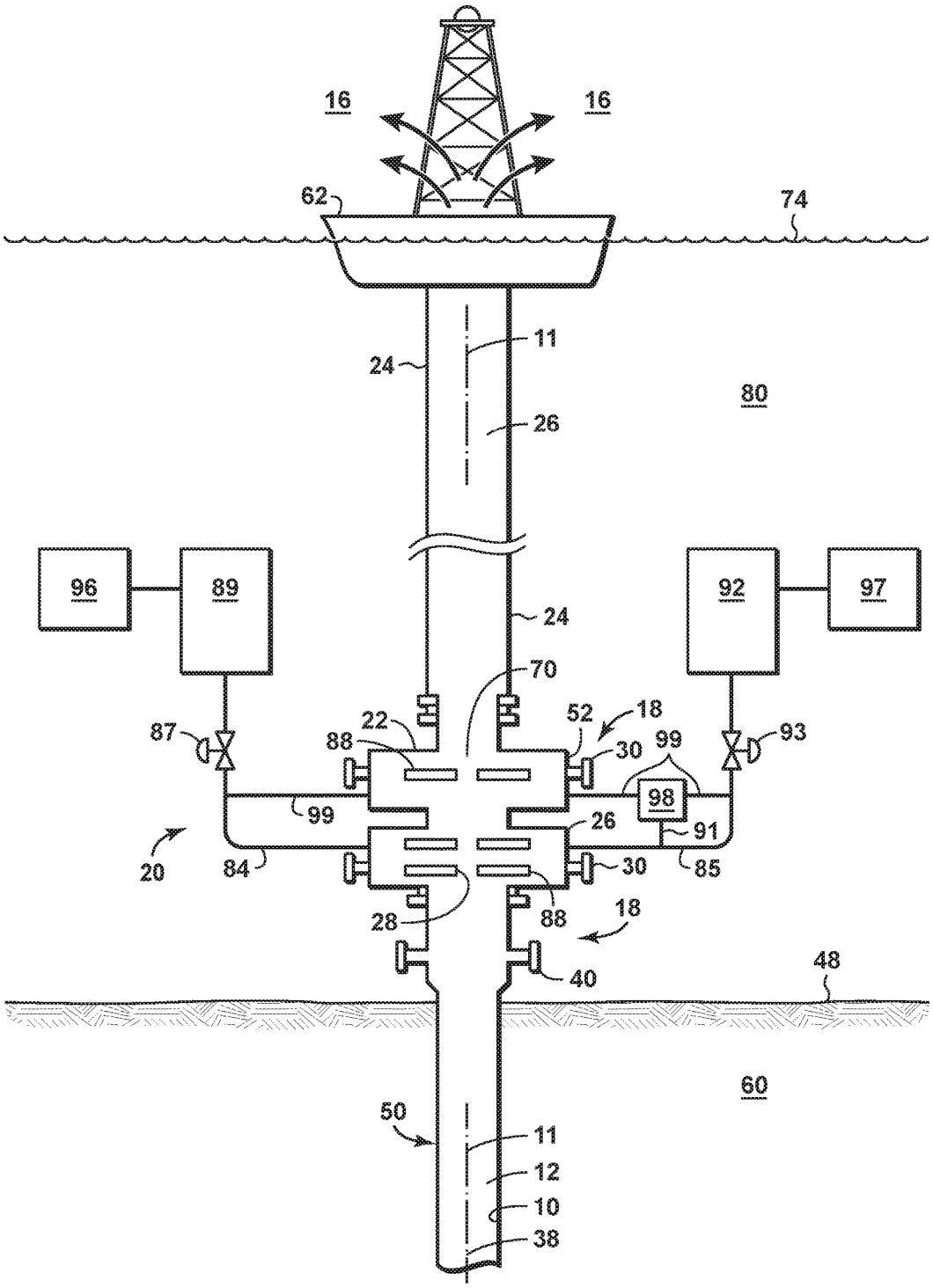
FIG. 3 is a further exemplary schematic representation of well control equipment arrangement and an exemplary illustration of use of well control equipment according to the present disclosure.

Certain key elements, components, and/or features of the disclosed technology are discussed herein with reference to FIGS. 1, 2, and 3, which are merely a general technical illustration of some exemplary aspects of application of the disclosed technology. Not all of the elements illustrated may be present in all embodiments or aspects of the disclosed technology and other embodiments may include varying component arrangements, omitted components, and/or additional equipment, without departing from the scope of the present disclosure. FIGS. 1, 2, and 3 merely provide simplified illustrations of some of the basic components used in drilling or servicing subterranean wells, particularly offshore wells, in accordance with the presently disclosed well control technology.

Generally, the presently disclosed technology involves providing equipment and materials in close proximity to the well control equipment that may form a plug to provide blockage or at least partial impedance of the wellbore blowout fluid flow rate through the wellbore. The disclosed equipment and materials may be provided at the lowest readily accessible point along the externally accessible or exposed portions of the wellbore, such as at the seafloor so as to provide as much wellbore throughbore as possible above the point of plug-forming agent introduction into the wellbore to provide as much throughbore as possible for forming a well-controlling plug therein. In some aspects, the disclosed methods and equipment position the plug-forming agent and equipment on or near the sea-floor, such as in proximity to the BOP equipment.

The presently disclosed technology may be combined with other well control technologies, such as methods and systems for temporarily dynamically killing a blowout fluid by introducing substantial additional fluid into the flow stream at such rate and pressure as to create an increased backpressure in the wellhead throughbore that creates sufficient additional pressure drop in the flow control device throughbore that overcomes all or at least a portion (such as at least 25% of) the flowing wellbore pressure of the blowout fluid flow rate through the wellhead. This optional additional fluid may be referred to herein as a "control fluid." When both the presently disclosed plug-forming agent process and the control fluid process are both utilized, the plug-forming agent and the additional control fluid may be introduced simultaneously or sequentially, using the same introduction aperture(s), in separate apertures, and/or a combination of both so as to accommodate avoiding premature mixing of reactive components.

In many embodiments, the plug-forming fluid may be introduced in proximity of an upper or top end of the wellbore, such as into the wellhead, drilling spool, or in a lower portion of the blowout preventer, or in adjacent equipment such as well control devices (e.g., blowout preventers, marine risers, riser disconnects, master valves, etc.) that have an internal arrangement of components exposed to the wellbore that creates a relatively restrictive turbulence of control fluid and formation fluid therein. According to the present disclosure, a plug-forming agent, such as a resin, gel, polymer or monomer that can be polymerized and/or crosslinked may be introduced into the wellbore throughbore, either while the well is flowing blowout fluid, or after blowout fluid flow rate has been suspended or arrested, so as to create a polymer plug within the wellbore throughbore and/or related equipment. The term "polymer" as used herein, not only includes its common definition of a chain of mer units, but is also used to broadly encompass other physically similar materials, such as resins, gels, and thermoplastics that may change physical state within the wellbore into a substantially solid plug therein.

The plug-forming agent may be introduced in conjunction with introduction of another control fluid, such as seawater, either via the same introduction apertures or in separate apertures. Portions of the plug-forming agent may be mixed with the control fluid, such as portions that are non-reactive with and compatible with the control fluid, such as the polymer, while other reactive portions are introduced separately from the control fluid or separately from the reactive portions of the plug-forming agent, such that polymerization reaction and/or crosslinking may occur within the wellbore throughbore, before the plug-forming agent is discharged by the blowout formation fluid from within the wellbore throughbore. The plug-forming reaction kinetics therefore has to occur relatively quickly upon mixing in the wellbore.

It may be desirable in some applications to introduce control fluid into the wellbore prior to introduction of the plug-forming agent in order to gain control of the blowout fluid flow rate from the wellbore. Thereafter, the plug-forming agent may be introduced into the wellbore throughbore (via either the same apertures as the previously or concurrently introduced control fluid or via separate apertures) to create or begin forming the polymer plug in the wellbore throughbore. Control fluid introduced into the wellbore throughbore for purposes of securing rate control on the wellbore blowout fluid flow rate, in advance of introducing the plug-forming agent or control fluid mixed with the plug-forming agent, may for clarity purposes be referred to herein as the "preliminary" control fluid. In many applications, the control fluid and the preliminary control fluid may substantially be the same fluid composition (e.g., comprised primarily of water, such as seawater) except for absence of the plug-forming agent in the preliminary control fluid.

According to some aspects of the technology provided herewith that utilize the introduction of the preliminary control fluid and/or the control fluid in addition to the plug-forming agent, the preliminary control fluid and/or control fluid introduction rate may be sufficiently high so as to hydrodynamically create a flowing wellhead pressure drop within the wellhead primary throughbore and/or related equipment due to the increased fluid volume in the throughbore, and due to hydrodynamic backpressure, mixing, and turbulent flow patterns therein. In such dynamic well killing operations, the combined fluid volume through the wellbore is sufficiently great so as to cause a pressure drop therein that exceeds the formation blowout fluid flowing pressure at that point of control fluid introduction into the wellbore. The plug-forming agent may create an increasing accumulation or building up of plug-forming agent on the wellbore throughbore surfaces. In other applications, it may be desirable to skip or eliminate the step of introducing the preliminary control fluid and merely introduce the plug-forming agent and/or control fluid directly into the wellbore throughbore as the primary method of plugging off the wellbore throughbore.

It may be desirable to only introduce the plug-forming agent into the wellbore throughbore, without using preliminary control fluid introduction or parallel control fluid introduction in order to gain hydrodynamic blowout fluid rate control. In such instances, the objective may be to rely primarily upon the plug-forming agent to act substantially without other rate reduction methods, such that the plug-forming agent builds up and gradually plugs off or constricts the blowout fluid flow rate without benefit of other blowout fluid rate restriction means. After plugging off the blowout fluid flow rate, the well may be permanently equipped and killed with cement or other permanent solutions.

One advantage of the present technology is locating the operational equipment and material for the plug-forming agent system as low as readily possible along the wellbore length, such as at the seafloor, and thereby remote to the rig floor or area of potential operation risk. The system may be selectively controlled or operated locally, remotely, automatically, manually, or as part of a distributed service system that serves more than one well. The presently disclosed methods and systems have the advantage of being remotely operable away from the rig, vessel, or platform experiencing the blowout, as all operations may be performed from a workboat or other vessel that is safely distant from the blowout. By operating remotely from the drilling rig, the well-control system or operation will not be impacted by failure of the drilling rig. Further, pumping seawater into the well control device as the control fluid, not only provides an infinite source of control fluid, but also brings the advantage of adding firefighting water into the fuel in the event that the hydrocarbons are ignited after escaping onto the drilling rig. This system could save the rig, control the well, and if desired also provide means for introducing environmental-cleanup-aiding chemicals directly into the blowout effluent stream.

Another advantage offered by the present technology is that it is compatible with other well control approaches, such as the control fluid technique discussed above. The control fluid system may utilize readily available and environmentally compatible water or seawater. For offshore wells or wells positioned on lakes or inland waterways, this creates essentially a limitless source of control fluid, as the control fluid is merely circulated through the system. (For land-based wells, a water source such as a bank of tanks may be provided to facilitate circulating water from the tanks, into the primary throughbore, and back to the tanks or to another contained facility where the water may could be processed and reused.) As an additional benefit, introducing seawater as the control fluid brings the added benefit of fire suppression and thermal reduction in event the effluent is on fire or has possibility of ignition.

When wellbore blowout fluid flow rate is sufficiently reduced or stopped by the control fluid and/or the plug-forming agent, a heavier weighted fluid subsequently can be introduced into the wellbore through a weighted fluid aperture to permanently kill the controlled well. The weighted fluid aperture may preferably be positioned below the control fluid aperture. The weighted fluid can fall by gravity through the wellbore blowout fluid in the wellbore and/or displace the blowout fluid as the weighted fluid moves down the wellbore and begins permanently killing the well blowout. Introducing the plug-forming agent into the wellbore throughbore may continue while the additional well killing operation of introducing the weighted fluid into the wellbore progresses. Introducing the weighted fluid in parallel with introducing the control fluid and/or plug-forming agent may continue until the wellbore is fully hydraulically stabilized and no longer has the ability to flow uncontrolled.

FIG. 1 illustrates an exemplary equipment arrangement for a well control operation according to the present disclosure, whereby wellbore 50 is experiencing a well control event and an operation according to the present disclosure is employed to intervene and kill the flow of effluent from wellbore 50. In the exemplary aspect illustrated in FIG. 1, a service vessel 72 is positioned safely apart from or remote offset from the rig 62 or well centerline 11. Exemplary vessel 72 may be loaded with equipment, pumps, tanks, lines, drilling mud, cement, and/or other additives as may be useful in the well control operation. Exemplary vessel 72 also provides pumps 32, 42 for introducing fluids into the wellbore 50. A wellbore 50 is located within a subterranean formation 60, whereby the wellbore is in fluid communication with a reservoir or formation containing sufficient formation fluid pressure to create a well control situation such as a blowout. Top side well control or operation-related equipment is positioned at several points along the wellbore 50 above the surface location (such as mudline 48 or water surface 74) including at water surface 74. Wellbore 50 is discharging the wellbore fluid 16 in an uncontrolled flow, from substantially any location downstream (above) of the wellhead pressure control devices 20. Wellbore fluid 16 may be escaping or discharged at substantially any location downstream from at least a portion of the well control surface equipment 20 or from the wellbore throughbore 12, such as near the mudline 48, on a rig or surface vessel 62 or therebetween. FIG. 1 illustrates the presence of a plurality of well control devices 20, such as a blowout preventer 26 (BOP), a lower marine riser package 22 (LMRP), and a marine riser 24. Wellhead pressure control device 20 are illustrated in the Figures as engaged with a top end 18 of wellbore 50, with respect to the portion of the wellbore below the mudline 48. In other aspects, the top end of the wellbore 50 may be in proximity to the rig or surface vessel 62. Wellbore 50 includes a wellbore conduit 10 defining a wellbore throughbore 12 therein, such as a well casing string(s). The collective components comprising the well control device 20 each include a primary throughbore 70 substantially coaxially aligned along a wellbore centerline 11 with the wellbore throughbore 12, but not necessarily having the same primary throughbore internal radial dimensions 28 as the wellbore conduit 10. The primary throughbore 70 may be irregular with respect to internal radial dimensions 28 between various components therein, such as pipe rams 88, wipers, master valves on a christmas tree, plug profiles, and will possess varying internal surface roughness and dimensional variations so as to contribute to creation of turbulent fluid flow therein that under conditions of sufficiently high flow rate may create a substantial pressure drop therein that may impede the combined flow rate of formation blowout fluid and control fluid through the primary throughbore 70, thus aiding in creating enhance backpressure on wellbore 50, and reducing or halting effluent 16 flow.

In one general aspect, the disclosed technology includes a method of performing a well control intervention operation to reduce an uncontrolled flow of wellbore blowout fluids 16 such as a blowout from a subterranean wellbore 50. The term "blowout" is used broadly herein to include substantially any loss of well control ability from the surface, including catastrophic events as well as less-notorious occurrences such as for plugging BOP leaks, related to the inability of using the other conventional pressure/flow control equipment 20 to contain and control the flow of effluent fluid 16 from within a wellbore conduit 10 into the environment outside the well 50.

As illustrated in FIGS. 1 and 2, the disclosed methods may comprise providing (either by addition to the wellbore or as a preexisting component of the wellbore assembly) at least one wellhead flow control device 20, such as a BOP 26, LMRP 52, casing heads, tubing heads, Christmas tree valve arrangement, and snubbing equipment. The term "BOP" is used broadly herein to generally refer to the totality of surface or subsea well pressure or fluid controlling equipment present on the wellbore that comprises at least a portion of the wellbore throughbore 12 and which is typically appended to the top end 18 of the wellbore conduit 10 during an operation of, on, or within the well 50. The main internal well control device 20 throughbore 22 within the flow control devices 20 may be referred to broadly herein as including the primary throughbore 22. The wellbore throughbore 12 includes the primary throughbore 22. The wellhead pressure control device 20 is typically engaged with a top end 18 of the wellbore conduit 10 at a surface location of the wellbore conduit, such as at the seafloor mudline 48 (or land surface or platform or vessel surface). The primary throughbore 22 is coaxially aligned with the wellbore throughbore 12 and the primary throughbore conduit 70 comprises internal dimensional irregularities such as constrictions and discontinuities, along the primary throughbore conduit 70 inner wall surfaces. These irregularities may be due to varying positions and dimensions related to internal components such as pipe rams, plug seats, master valves, or other internal features that may create a substantially discontinuous or irregular conduit path along the axial length of the primary conduit 70.

A control fluid aperture(s) 30 is provided in proximity to the fluid control device 20, preferably located either in a lower half of the fluid control device 20 or at a point in the wellbore conduit 10 below (upstream with respect to the direction of blowout fluid flow) the fluid control device 20, such as in a drilling spool, a drilling choke-kill cross. The control fluid aperture 30 may include multiple numbers or variations of type and location of such apertures. The control fluid aperture 30 facilitates an entry location to introduce the control fluid and/or the plug-forming agent into the wellbore throughbore. In some aspects, the control fluid apertures are sized such that the control fluid and/or plug-forming agent may be introduced at a desired or sufficient rate, volume, and/or pressure to impede or halt flow of formation fluid 16 through at least the portion of the wellbore throughbore or conduit below the control fluid aperture 30.

The control fluid aperture 30 facilitates introducing a plug-forming agent alone or control fluid that includes the plug-forming agent, and including other control fluid components such as seawater, freshwater, drilling fluid, etc., into the wellbore throughbore 12 for increasing hydrodynamic fluid pressure and inertial energy within the primary throughbore 70 section of the wellbore throughbore 12 so as to arrest flow of blowout fluid. The control fluid aperture 30 may be provided in the top end 18 of the wellbore conduit 10, meaning substantially anywhere along the wellbore throughbore 12 above (uphole from) the bradenhead flange or mudline, wherein the control fluid aperture is also fluidly connected with the wellbore throughbore, or combinations thereof. The ports may be generally provided substantially perpendicular to the axis of the throughbore. In other aspects, the control fluid aperture 30 may be provided in at least one of (i) the top end of the wellbore conduit, (ii) the flow control device, and (iii) a location intermediate (i) and (ii), the control fluid aperture being fluidly connected with the wellbore throughbore, or combinations thereof.

In addition to the control fluid aperture 30, the disclosed technology provides a weighted fluid aperture 40 for introducing a weighted fluid into the wellbore below the control fluid aperture 30 to provide the hydrostatic control and containment of well effluent 16 from the wellbore 50. In some aspects it may be preferred to locate the weighted fluid aperture 40 in the wellbore throughbore 12 in proximity to the mudline 28, such as near the top end 18 of the wellbore conduit 10, or in a lower portion of the fluid control device 20 that is below the control fluid aperture. The term "below" means an upstream location in the wellbore throughbore with respect to direction of flow of wellbore blowout fluid 16 flowing through the throughbore 12. In some embodiments, the control fluid aperture may be located within a BOP body, between BOP rams, or in a drilling spool (choke-kill spool), or combinations thereof. In some aspects, it may be useful to provide the control fluid aperture 30 in the well control device 20 and providing the weighted fluid aperture in another wellbore component below (upstream with respect to the direction of flow of wellbore blowout fluid flowing through the wellbore throughbore) from the well control device 20, or in both locations to have sufficient control fluid introduction capacity. In some embodiments, it may be desirable to introduce plug-forming agent through the weighted fluid aperture, such as to maximize the reaction time that the plug-forming agent has to react or mix within the wellbore throughbore above the point of plug-forming agent introduction.

Introducing a control fluid through the control fluid aperture 30 into the wellbore throughbore 12 while wellbore blowout fluid 16 flows from the subterranean formation 60 through the wellbore throughbore 12 may in some instances provide sufficient backpressure to both temporarily control and permanently control the well. In the case of a relatively low-pressure wellbore (e.g., one having a BHP gradient of less than a seawater, kill mud, or freshwater gradient) the control fluid alone may perform to both temporarily control the well and with continued pumping also serve as the weighted fluid to fill the wellbore with control fluid and permanently kill the well. It may be advantageous to introduce at least a portion or as much as possible of the control fluid and/or plug-forming agent into the primary through bore 20 as far upstream (low) as possible, such as in the lower half of the BOP 26, such as below BOP mid-line 15, without hydraulically interfering with introduction of the weighted fluid into the weighted fluid aperture 40.

The presently disclosed technology also includes an apparatus and system for performing a wellbore intervention operation to reduce an uncontrolled flow rate of wellbore blowout fluids from a subterranean wellbore. In one embodiment, as illustrated in exemplary FIGS. 1 and 2, the apparatus or system may comprise a flow control device 20 mechanically and fluidly engaged (directly or including other components engaged therewith) with a top end of a wellbore conduit (generally the wellhead at the surface or mudline, but in proximity thereto such as in a conductor casing or other conduit in proximity to the mudline or surface) that includes a wellbore throughbore 12 at a surface location 48 of the wellbore conduit, the flow control device 20 including a primary throughbore 70 that is included within the wellbore throughbore 12, the primary throughbore 70 coaxially aligned with the wellbore throughbore 12 and the primary throughbore 70 comprising internal dimensional irregularities. "Internal dimensional irregularities" and like terms refers to the primary throughbore 70 having a non-uniform effective internal conduit-forming surfaces or internal cross-sectional area or internal diameter dimensions, along the axial length of the primary throughbore 70 as compared with the substantially uniform internal diameter of the wellbore conduit 10. The internal dimensions of the primary throughbore may be less than, greater than, or in some instances substantially the same as the internal diameter of the wellbore conduit 10. "Internal dimensional irregularities" variations include the internal component positional and size variations within the various apparatus, valves, BOP's, etc., that comprise the primary throughbore 70 downstream from (above) the weighted fluid introduction aperture. Such diameter variations provide internal fluid flow-disrupting edges and shape inconsistencies along the axial length of the primary throughbore 70 that collectively may facilitate substantial turbulent flow and enhanced rate restriction, resulting in increased hydraulic pressure drop along the primary throughbore 70.

In some applications, the plug-forming agents may be agents that attach or adhere to a metal site for polymerization or reaction catalysis, or otherwise mechanically bond or chemically bond (e.g., ionic or covalent) with the metal surface of the wellbore throughbore. It may be desirable in some applications to treat or prewash the metal surfaces before introducing the plug-forming agent, such as with a solvent, detergent, surfactant, acid, and/or steam to remove deposits such as paraffin, scale, gel, wax, paint, hydrocarbons, or other material that may block interaction or bonding between internal metal surfaces and the plug-forming agent.

Preliminary control fluid, control fluid, and/or plug-forming material may be introduced into the wellbore throughbore in sufficient rate to create a substantial hydrodynamic pressure drop within the primary throughbore 70, such as a pressure drop of at least 10%, or at least 25%, or at least 50%, or at least 75%, or at least 100% from the previously estimated or determined flowing hydraulic pressure of the wellbore blowout fluid within the primary throughbore 70 before introduction of the plug-forming agent therein. It is anticipated that the control fluid may commonly need to be introduced into the primary throughbore 12 at a control fluid introduction rate that is at least 25%, or at least 50%, or at least 100%, or at least 200% of the previously estimated or determined wellbore blowout fluid 16 flow rate from the wellbore throughbore 12 prior to introducing the control fluid into the wellbore throughbore 12. In another aspect, it may be desired that when substantially only, or at least a majority by volume, or at least 25% by volume of the total fluid flowing (formation effluent plus control fluid) through the downstream, outlet end of the primary throughbore 70 is control fluid, then a weighted fluid such as weighted mud, cement, weighted kill fluid, or heavy brine may be introduced preferably through the weighted fluid aperture 40 and into the wellbore throughbore 12 while pumping the control fluid through the control fluid aperture 30.

There may be applications where it is desired to begin pumping weighted fluid through the control fluid aperture, such as to create additional turbulence and flow impedance within the wellbore throughbore, either solely or in combination with introducing weighted fluid into the weighted fluid aperture. The weighted fluid may be substantially the same fluid as the control fluid, or another weighted fluid, and the weighted fluid may comprise the plug-forming agent.

When the well is killed (exhibiting either reduced flow rate or halted flow rate of formation fluids from the reservoir or formation 60) due to introduction of control fluid into the primary throughbore 70, the well will still be flowing the control fluid from the primary throughbore 70 exit. In many instances it is preferred that the well is killed with respect to flow of formation effluent through the primary throughbore, and substantially all of the fluid discharging from the primary throughbore 70 is control fluid. Thereby, wellbore blowout fluid 16 is effectively replaced with control fluid such as seawater 80 and/or plug-forming agent.

Introducing "neat" preliminary control fluid (without additives) into the wellbore throughbore 12 may or may not fully contain or halt formation fluid flow from the well 50 as desired. Some aspects of the disclosed technology may include tailoring the control fluid. In other aspects, it may be desirable to provide additives 86 to the control fluid (or the weighted fluid) by adding fluid-enhancing components therein, such as salts, alcohols, surfactants, biocides, and polymers. In some embodiments, the control fluid may comprise at least one of carbon dioxide, nitrogen, air, methanol, another alcohol, NaCl, KCl, MgCl, another salt, and combinations thereof.

In some operations it may be desirable to introduce fluid streams comprising or consisting essentially of plug-forming formulations (e.g., mass-growing or accumulating) that physically or chemically activate or react within the wellbore throughbore, such as within the primary throughbore 70, to create a solid, semisolid, plastic, or elastic accumulation within the wellbore throughbore. Such plug-forming formulations may comprise a combination of components that polymerize, deposit, react, mix, crosslink, or active when combined within the wellbore throughbore, either with each other and/or with the wellbore blowout fluid. The components comprising the plug-formulations, the formulations may be separately introduced into the wellbore throughbore for mixing therein and (relatively quickly) reacting therein while still located within the wellbore throughbore.

Such plug-forming agent may also include chemical or true polymer formulations that are water or hydrocarbon activated compositions. The activated plug-forming agent(s) may accumulate or otherwise structurally build up within the primary throughbore, creating a flow path restriction, constriction, or full blockage of the fluid flow rate through the wellbore throughbore. Fibrous and/or granular solids such as nylons, kevlars, durable materials, and/or fiberglass materials may also be concurrently introduced for enhancing the toughness or shear strength of the polymer accumulation within the primary throughbore 70.

According to the present disclosure, provided is an apparatus, system, and/or method of performing a subterranean wellbore intervention operation to reduce an uncontrolled flow of wellbore blowout fluid from a subterranean wellbore, the method comprising: providing a flow control device, the flow control device engaged proximate a top end of a wellbore conduit that includes a wellbore throughbore, the flow control device including a primary throughbore coaxially aligned with and comprising a portion of the wellbore throughbore; providing a control fluid aperture proximate the top end of the wellbore conduit, the control fluid aperture being fluidly connected with the primary throughbore; providing a weighted fluid aperture in the wellbore throughbore at an upstream location in the wellbore throughbore with respect to the control fluid aperture and with respect to the direction of wellbore blowout fluid flow through the wellbore throughbore; introducing a control fluid through the control fluid aperture and into the wellbore throughbore while the wellbore blowout fluid flows from the subterranean formation through the wellbore throughbore at a wellbore blowout fluid flow rate, whereby the control fluid comprises a plug-forming agent comprising at least one of a polymerizable monomer and a polymer; and at least one of polymerizing and crosslinking the plug-forming agent within the wellbore throughbore to create a barrier to flow of the wellbore blowout fluid through the wellbore throughbore. In some aspects, the method includes introducing a weighted fluid through the weighted fluid aperture and into the wellbore throughbore.

The plug-forming agent may, in some aspects be introduced into the wellbore in the form of an agent that can further polymerize and/or is crosslinkable, preferably within the brief time span with which the plug-forming agent is positioned within the wellbore throughbore and/or in components related thereto. A polymerization catalyst may be utilized with or provided with some plug-forming agents. The polymerization catalyst may mix with the plug-forming agent within the wellbore throughbore. The plug-forming agent may comprise two components that are introduced separately into the wellbore to react within each other within the wellbore. In other embodiments, a suitable plug-forming agent may be one that reacts with the blowout fluid (hydrocarbons and/or water) so as to create the desired restriction in the wellbore.

The plug-forming agent may comprise two or more components that are introduced separately into the wellbore to react with each other within the wellbore. The term "plug-forming" is defined broadly herein to include polymerization and crosslinking, so as to form a substantially solid, plastic, or resinous plug within the wellbore throughbore. Other suitable states for the plug-forming agent may include stiff gels, scales, and elastomers. Crosslinking may be affected with or without a chemical cross-linking agent, such as by physical mixing.

In one aspect, an exemplary plug-forming agent according to the present disclosure comprises a dicyclopentadiene (DCPD). DCDP may be crosslinked using a Grubbs' Ru-based ring opening metathesis catalyst to crosslink the dicyclopentadiene (DCPD). The polymerization reaction may be effected relatively rapidly so as to occur within the short time-period within which the plug-forming agent is axially positioned within the wellbore throughbore. With proper choice of catalyst, the reaction may be tailored to occur at a specific temperature, such as at or above 50 degrees C. Thus, this solution can be pumped at relatively high rates into a flowing wellbore throughbore, such as through a control fluid port below a BOP to form a barrier to formation blowout fluid flow. The integrity of the formed plug may be enhanced, such as by including strengthening agents such as a cellulose bridging agent, a solid material, and/or fibrous materials that are mixed in the DCDP solution prior to injection.

In another aspect, an exemplary plug-forming agent includes a siloxane that may be polymerized and/or cross-linked. Siloxanes may be comprised of appropriate alkoxy groups, such as but not limited to MethOxy (MeO—) groups and/or EthOxy (EtO—) groups that may crosslink in the presence of water, such as in seawater, and eliminate the use of methanols or ethanols for crosslinking. The siloxane and water may require injection through separate lines if cross-linking conditions cause the crosslinking reaction to occur too quickly, or alternatively the siloxane may cross-link on contact with seawater during pumping for introduction in relatively shallow conditions where wellbore introduction timing is quicker. When siloxane and water mix, polymerization and/or crosslinking may occur, including both physical and chemical crosslinking. Thermal energy from the wellbore fluid may be utilized to catalyze or assist with the polymerization and crosslinking, such as at or above a desired temperature. The plug-forming agent may be heated or the water may be heated, or steam or another heated fluid, such as the control fluid, may be introduced into the wellbore throughbore to assist with polymerization and cross-linking. Bridging agents such as solids or fibers also may be utilized with the siloxanes to enhance plug strength. The resulting siloxane and water polymer product may react with or in contact with metal surfaces within the wellbore throughbore and create a buildup of a relatively hard, wellbore plug-forming agent. As the introduction and reaction processes continue, more and more reaction product is built up until the buildup creates a blockage within the wellbore throughbore (particularly in proximity to the point of introduction of the plug-forming agent) sufficient to choke off or kill the flow of wellbore blowout fluid from the wellbore.

In some applications it may be desirable to introduce control fluid (including either the preliminary control fluid or the control fluid comprising the plug-forming agent) into the wellbore throughbore 12 at a control fluid introduction rate sufficient to reduce the wellbore blowout fluid flow rate by determined amount, such as achieving a reduction of at least 10%, or 25%, or 50%, 75%, or 90%, or at least 100%, (by volume) with respect to the wellbore blowout fluid 16 flow rate through the wellbore throughbore 12 or primary throughbore 70, prior to introduction of the control fluid into the primary throughbore 70.

One option for maintaining the well in a controlled state while introducing the plug-forming agent is to hydrodynamically control the well through one group of control fluid ports, while introducing the plug-forming agent through a separate set of control fluid apertures, typically below or upstream of the hydrodynamic control fluid introduction ports. Thereby, the plug-forming agent may be introduced into a lower-energy region within the wellbore throughbore, than if the agent were introduced via the high-energy control fluid ports. Another option however, is to introduce the plug-forming agent into the higher energy control fluid ports to benefit from the mixing energy or as a consequence of limited number of control fluid introduction apertures.

Referring to FIGS. 1, 2, and 3, in some aspects, the disclosed apparatus or system may include, for example, control fluid aperture 30 in at least one of (i) the top end of the wellbore conduit, (ii) the flow control device, and (iii) a location intermediate (i) and (ii), the control fluid aperture being fluidly connected with the wellbore throughbore. The control fluid aperture 30 facilitates introducing (such as by pumping or by gravitational flow) a control fluid into the wellbore throughbore 12 while a wellbore blowout fluid flows from the subterranean formation 60 through the wellbore throughbore 12 at a wellbore blowout fluid flow rate, whereby the control fluid is introduced at a control fluid introduction rate of at least 25% (by volume) of the estimated or determined wellbore blowout fluid flow rate was from the wellbore throughbore prior to introducing the control fluid into the wellbore throughbore. Again, these and other rates referred to herein apply to the control fluid introduction process, either as a preliminary control fluid or a control fluid introduced in conjunction with introduction of the plug-forming fluid.

A weighted fluid aperture 40 is also provided for introducing weighted fluid into the wellbore throughbore 12. The aperture 40 is positioned at an upstream location in the wellbore throughbore with respect to the control fluid aperture and with respect to direction of flow of wellbore blowout fluid flowing through the wellbore throughbore (e.g., the weighted fluid aperture 40 is generally positioned below the control fluid aperture 30 and in some embodiments the weighted fluid aperture 40 may be positioned below the fluid control device 20 or near a lower end of the fluid control device 20. The weighted fluid aperture 40 is sized and/or provided by sufficient number of apertures 40 to be capable to introduce a weighted fluid into the wellbore throughbore 12 while the control fluid is introduced into the wellbore primary throughbore 70 through the control fluid aperture 30, from a control fluid conduit line 34 and a control fluid pump 32.

"Flow control device" 20 is a broad term intended to refer generally to the any of the pressure and/or flow control regulating devices associated with the top end 18 of the wellbore 50 that are positioned upon (above) the well 50, including equipment near a mudline 48, an earthen surface casing bradenhead flange, or other water surface, that may be used in conjunction with controlling wellbore pressure and/or fluid flow during a well operation. The collection and various arrangements of the flow control devices associated with the top end 18 generally define the "primary throughbore" 20 portion of the wellbore throughbore 12. The top end 18 of the primary throughbore 70 comprises that portion of the well assembly above and mechanically connected with the wellbore bradenhead flange. Exemplary well operations using a flow control device include substantially any operation that may encounter wellbore pressure or flow, such as drilling, workover, well servicing, production, abandonment operation, and/or a well capping operation, and exemplary equipment includes at least one of a BOP 28, LMRP 52, at least a portion of a riser assembly, a production tree, choke/kill spool, and combinations thereof. The plugs formed according to the present disclosure will typically be formed within the flow control devices and related equipment, positioned substantially at or above ground level or above the sea floor in an offshore application. The interior portion of such equipment is considered as comprising a portion of the wellbore throughbore.

The present apparatus or system also includes a control fluid conduit 34 and a control fluid pump 32 in fluid communication with the control fluid aperture 30. The control fluid conduits may comprise one or multiple lines as necessary, and may be utilized for conveyance and introduction of the plug-forming agent from a pump source and into a control fluid aperture. In some aspects, source fluid for the pump may be drawn from a fluid reservoir or water body, such as by using suction line 82 in fluid connection with the adjacent water source 80, such as the ocean, a freshwater source, large water tanks, etc. Using seawater or other readily available fluid as the control fluid whereby the blowout effluent is discharging into the ocean provides a substantially limitless source of environmentally compatible control fluid. Thereby, the limitations on control fluid introduction rate and duration are merely mechanical limitations that may be addressed or enhanced separately such as during planning stages for the well and equipment (e.g., control fluid aperture size and number of apertures available, pressure ratings, pump capacity, etc.). Multiple apertures fluidly connected with the wellbore throughbore 12 may be utilized as the control fluid apertures 30, at least some of which may be provided for other uses as well.

The control fluid apertures 30 may be located substantially anywhere within and/or upstream of (below) the primary throughbore 70. A weighted fluid aperture 40 should be provided upstream of (below) the lower-most (closest) control fluid aperture 30. In many embodiments, the most downstream (highest) weighted fluid aperture 40 is upstream of (below) the lower-most (closest) control fluid apertures 30, by at least 3 but more preferably at least 5 and even more preferably at least 7 wellbore conduit effective internal diameters of the wellbore blowout fluid 16 flow stream. In such embodiments the most upstream (lowest) control fluid aperture 30 is downstream of (with respect to the direction of flow of the wellbore blowout fluid) the highest (most upstream) weighted fluid aperture 40. Stated differently, the weighted fluid aperture 40 is upstream of (below) the nearest control fluid aperture 30, by at least 3, 5, or 7 internal diameters of the wellbore conduit throughbore 12.

Thereby, the introduced weighted fluid does not encounter the majority of the mixing and most turbulent hydraulic energy area imposed within the primary throughbore 70 portion of the wellbore throughbore 12. It may also be preferred in some aspects that the weighted fluid aperture 40 is positioned upstream (below) of the primary throughbore 70 portion of the wellbore throughbore 12, such as in proximity to the casing bradenhead flange or a spool positioned thereon. The weighted fluid aperture may in some instances be utilized for introduction of the plug-forming agent and/or a portion of the control fluid until such time as the well becomes plugged off, controlled, and killed, whereby it may become appropriate to then introduce a weighted fluid through the weighted fluid aperture.

It may be desirable in some aspects that control fluid pump 32 and control fluid conduit 34 are capable of pumping control fluid through the control fluid aperture(s) 30 and into the wellbore throughbore 12 at a control fluid introduction rate of at least 25%, or at least 50%, or at least 100%, or at least 200% (by volume) of the wellbore blowout fluid flow rate through the wellbore throughbore 12 that was estimated or determined prior to introduction of the control fluid into the wellbore throughbore 12. The larger the total volumetric fluid flow rate through the primary throughbore 70, the greater the total hydraulic pressure drop created therein by the combined fluid streams. Thus, the larger the volumetric fraction of control fluid introduced therein at near maximum primary throughbore flow capacity that comprises the total fluid stream, the lower the volumetric fraction of wellbore effluent 16 escaping into the environment from the wellbore 50.

It may be desirable in other aspects to introduce sufficient control fluid into the primary throughbore that the fractional rate of wellbore effluent from the reservoir is substantially zero or incidental. In another aspect, it may be desirable that an estimated or determined at least 25% by volume, or at least 50%, or at least 75%, or at least 100% by volume of the total fluid (control fluid plus formation effluent wellbore blowout fluid) flowing through the primary throughbore during introduction of the control fluid into the primary throughbore is control fluid. The weighted fluid may be introduced through the weighted fluid aperture and into the wellbore throughbore while concurrently introducing (e.g., pumping) the control fluid through the control fluid aperture.

The weighted fluid aperture 40 is positioned preferably below the control fluid aperture 30 and the weighted fluid aperture(s) is dimensioned to provide flow rate capacity to introduce weighted fluid into the wellbore throughbore at a rate whereby the weighted fluid falls through the stagnant or reduced velocity wellbore blowout fluid effluent flow rate through the wellbore throughbore 12. In some applications such as when it may be desirable introduce a high rate of weighted fluid into the wellhead 18, it may be desirable to switch from introducing the control fluid into the control fluid aperture to introducing weighted fluid into the control fluid aperture, such as while also introducing weighted fluid into the weighted fluid aperture.

In other embodiments, according to the presently disclosed technology, such as illustrated in FIG. 2, another fluid conduit 92 may be inserted into the primary throughbore 70, serving to (1) reduce the effective cross-sectional flow area of the primary throughbore due to the presence of the additional conduit therein, and (2) to introduce selectively, either additional control fluid into the primary throughbore 70 or to introduce weighted fluid into the wellbore throughbore 12. The additional conduit may facilitate an additional means for also directly taking measurements within the primary throughbore or wellbore conduit, such as the flowing fluid pressure at various points or depths along the primary throughbore 70 or in the wellbore throughbore 12.

Introducing control fluid and/or the plug-forming agent into the primary throughbore 70 through the additional conduit 44*a* may supplement introduction of control fluid into the primary throughbore, through the control fluid aperture 30 in order to gain control or cessation of flow of formation fluids 19 from wellbore 50. In many aspects, control fluid is introduced into the primary throughbore from as many introduction points as available, including both the additional conduit 44*a* and through multiple control fluid apertures 30, in order to create sufficient pressure drop in the primary throughbore 70. In other aspects, introducing control fluid into the primary throughbore 70 through the additional conduit 44A may be performed in the absence of introducing control fluid into the primary throughbore using the control fluid aperture 40. Weighted fluid and/or plug-forming agent may be introduced into the wellbore conduit 10 using the weighted fluid aperture 40, the additional conduit 44*a*, or using both fluid aperture 40 and additional conduit 44*a*. Weighted fluid and/or the plug-forming agent may be introduced into the wellbore conduit 10 using the weighted fluid aperture 40, the additional conduit 44*a*, or using both fluid aperture 40 and additional conduit 44*a*.

With the wellbore 50 maintained in a temporarily "killed" state (exhibiting either halted formation fluid 19 loss from the wellbore 50) or "controlled state" (exhibiting at least 25 volume percent reduction in release of formation fluid from the wellbore 50), due to introduction of control fluid and/or the plug-forming agent through the control fluid aperture 30 and into the primary throughbore 70, weighted fluid and/or plug-forming agent may be introduced (or further introduced) into the wellbore throughbore 50. The weighted fluid (and optionally including the plug-forming agent) may be introduced into the wellbore through bore 12 from the weighted fluid aperture 40 and/or into the wellbore throughbore 12 from the additional conduit 44*a*. At least a portion of the weighted fluid (and optionally the plug-forming agent) may be introduced into the wellbore throughbore 12 by a separate conduit 44*a* inserted through the wellbore throughbore 50 and into the wellbore conduit 10. In such arrangement and method, at least a portion of the weighted fluid may be introduced into the wellbore conduit 10 from the top (downstream side) of the wellbore 50 or fluid control device 20.

In order to effectively introduce weighted fluid and/or plug-forming agent into the wellbore throughbore 12 below the turbulent primary throughbore section of the wellbore throughbore, such as below the top end of the wellbore conduit, it may be useful to insert the additional conduit 44*a* into and through the primary throughbore 70 (counter to the flow direction of the control fluid) to a point in the wellbore throughbore 12 below the lowest control fluid aperture 30. Preferably the fluid discharge outlet of the additional conduit is positioned within or inserted into the wellbore throughbore 12 to a position at least 3, but more preferably, at least 5, and even more preferably, at least 7 wellbore conduit, and yet even more preferably, at least 10 effective internal diameters of the wellbore throughbore 12, below the control fluid aperture 30 that is closest to the top end of the wellbore conduit 10 (below the lowest control fluid aperture 30), such as below the control fluid aperture 30 closest to the casing bradenhead. Stated differently, the discharge outlet of the weighted fluid conduit 40 is upstream of (below) the nearest (lowermost) control fluid aperture 30, by at least 3, 5, or 7 internal diameters of the wellbore conduit throughbore 12. Thereby, the weighted fluid is introduced into the wellbore throughbore 12 at a discharge or introduction point upstream of (below) the turbulent high pressure region created within the primary throughbore 70 that is being maintained by ongoing introduction of the control fluid therein. The weighted fluid may be introduced through separate conduit 44*a* alone, or concurrently in conjunction with the previously discussed introduction of wellbore blowout fluid through wellbore fluid aperture 40, such as through weighted fluid conduit 44*b*. In many instances, weighted fluid may be simultaneously introduced through both conduits 44*a* and 44*b*.

Due to the hydraulic pressure created within the primary throughbore 70 and the hydrodynamic momentum and fluid flow from through the primary throughbore 70, introduction of the separate conduit 44*a* may require substantial downward, contra-flow insertion force on the separate tubing conduit that is greater than the opposing hydraulic force applied thereto by the effluent 16. Flow of control fluids and/or wellbore blowout fluids through the primary throughbore 70 causes the primary throughbore 70 to apply pressurized resistance to either fluid entry or conduit penetration into (and through) the primary throughbore 70. It may be helpful to provide a driving or inserting force to the additional conduit and rigidity in the additional conduit against deformation or bending while the additional conduit is inserted into the primary throughbore 70. One embodiment for forcing the separate conduit 44*a* into and through the primary throughbore 70 is use of a hydrajet or other type of fluid propulsion system, such as the exemplary illustrated hydrajet tool 92. Seawater may be pumped through well tubing 90, such as through coil tubing 93 or through jointed tubular pipe 91 such as drill pipe (either from rig 62 or other vessel 72), wherein the seawater provides propulsion force 31 to the hydra-jet tool 92. The hydrajet tool 92 may be provided with a rotating or steerable head 94 to help manipulate the tool 92 through the intricacies of the flow control devices 20. The hydraulic propulsion force 31 may be provided by substantially any convenient fluid, such as seawater or the control fluid. Thereby, the hydra-jet tool 92, well tubing 90 and separate conduit 44*a* may be moved by hydraulic propulsion force 31 from a position outside of the primary throughbore, such as illustrated at position A, into a proper position for introducing the weighted fluid 46 into the wellbore conduit 10, such as illustrated at position B. In some applications, it may be desirable to introduce plug-forming agent or portions thereof through the inserted well tubing 90 or hydrajet tool.

When the hydrajet tool positions the separate conduit 44*a* discharge opening properly below the control fluid aperture(s) and within the wellbore conduit 12, the weighted fluid 46 (for example) may be pumped such as from vessel 72, using pump 46, through line 44*a*, through tool 92 and into the wellbore throughbore 12 where the weighted fluid may fall through the wellbore blowout fluid within wellbore conduit 10, until the weighted fluid fills the wellbore 50 and the wellbore 50 becomes substantially depressurized (permanently controlled) at the top of the well 18. In another aspect, jointed tubing 91 such as drill pipe may be used in lieu of the hydrajet tool 92. The drill pipe may be weighted sufficiently to self-displace itself through the high-pressure primary throughbore 70 and into the wellbore.

For some wellbore operations, such as wellbores 50 having loss of pressure integrity issues below mudline 48 or a land surface 48 (such as an "underground blowout"), such as near bottom hole or at a midpoint along the wellbore length, jointed tubing may be preferred over coil tubing for insertion into the wellbore throughbore 12 in order that the relatively stiff and relatively heavy jointed tubing 91 can be run through the primary throughbore 70 to a selected depth in the wellbore throughbore 12, such as to a depth in proximity to the point of loss of wellbore pressure integrity (either bottom hole or point experiencing an underground blowout). Therein, weighted fluid and/or plug-forming agent may be introduced using the additional conduit 44*a* to create a hydrostatic head above the point of casing or wellbore failure or rupture. Weighted fluid may be supplemented with flow-impeding materials, such as with weighting agents, crosslinkers, additional polymers, cement, and/or viscosifiers.

In some operations, it may be desirable to introduce fluid streams comprising or consisting of a plug-forming agent, either in conjunction with the control fluid or as the control fluid, including polymer formulations that activate within the primary throughbore to polymerize or otherwise react to create a plug-forming agent accumulation within the primary throughbore 70. Polymer formulations may be introduced into the primary throughbore either through the control fluid ports, and/or through the additional conduit 44*a*. After formation flow through the primary throughbore is sufficiently arrested, weighted fluid may be introduced such as via either the additional conduit and/or the weighted fluid aperture to permanently kill the well.

Referring to FIG. 3 particularly, one method of performing various aspects of the presently disclosed technology is to position reservoirs 89, 92 containing the plug-forming agent(s) in close proximity to the flow control devices 20, such subsea, near the mudline 48, wellhead pressure control equipment 20. For example, the plug-forming agent may be provided in a self-contained reservoir or container 89, positioned on or near the seafloor 48, in close proximity to the blowout preventer stack 20. Some plug-forming agent systems may require separate plug-forming agent reservoirs, such as container 92, such as for two-component plug-forming agent system, whereby a first component reacts with another component to form the plug-forming agent.

The presently disclosed process and equipment may facilitate providing the plug-forming agent on full-time standby, near the lowest readily available point of convenient introduction into the wellbore. The subsea arrangement also safely locates such equipment off of a rig or platform where well blowout conditions may be adverse or potentially compromised. Subsea equipment positioning also readily facilitates convenient integration of the plug-forming agent introduction equipment with conventional well control equipment 20. A plug-forming agent system according to the present disclosure may be provided as a stand-alone package engaged with a wellbore or well control system or may be provided integrated into a conventional well-control package. The presently disclosed systems also may be retro-fitted into an existing well control system or provided as a new installation to existing equipment.

The plug-forming agent reservoirs 89, 92 and reservoir pressurization equipment 96, 97 may be installed before drilling or workover starts, during drilling or workover, or after an event has commenced. The introduction of the plug-forming agent into the wellbore 50 throughbore 70 may be selectively controlled by actuators valves 87, 93 and may be selectively actuated or operated autonomously in response to a remote signal, automatically in response to a detected well condition, or manually locally.

For plug-forming agent systems that rely upon mixing of two or more components to create the plug, such as a polymer and polymerization catalyst, or a polymer and cross-linker, or a two-part epoxy or resin catalyst system, the reacting components may be separately introduced into the wellbore for mixing therein, or a mixing chamber 98 and a fluid flow line arrangement such as illustrated by exemplary lines 99 may be optionally be provided to facilitate pre-mixing the reacting components prior to introducing the mixed components into the wellbore to form the plug. Other activating components may also be included as necessary, such as heating elements, pressurization pumps, particulate or fibrous materials introduction systems, and reservoir stirring or unsettling systems.

The system may be selectively actuated. FIG. 3 illustrates exemplary control valves 87, 93 that may be used with agent flow lines 84 and 85 for introducing the plug-forming agent into the wellbore, such as via BOP inlets 30 or casing head inlets 40.

Introduction of the plug-forming agent may be accomplished by any convenient pressurization method or process, as most appropriate for the particular plug-forming agent being introduced into the wellbore. The term pressurization is used broadly herein to refer not only to compression of fluids within the plug-forming agent reservoirs, but also includes direct pumping and mechanical displacement of the agent into the wellbore and/or mixing chamber. The various components may be connected using any convenient and appropriate system of lines, pipes, tubes, or hoses that are plumbed with the wellbore for selective operation as needed. In many applications, the plug-forming agent system will remain in a ready to use, standby state, regardless of whether pre-pressurized or pressurized during activation. For operations on multiple wells near a central position, various components of the well control system may be located centrally and connected via a distribution system, such as on the seafloor, located primarily locally at a wellhead location, or combinations thereof.

Pressurization of the plug-forming agent within the plug-forming agent reservoirs and distribution of the agent therefrom and/or within the plug-forming agent handling and routing system, and introduction into the wellbore may be performed according to any convenient process. In some aspects, pressurizing may comprise pre-pressurizing the first plug-forming agent reservoir in a stand-by readiness state prior to selectively introducing the first plug-forming agent into the wellbore, such as one of the various operational aspects used with a BOP accumulator system. In other aspects, pressurizing may include connecting the first-plug forming agent reservoir with a selectively actuatable pressurization system, such as a pressurizing fluid system, selectively actuatable pumps and pressurizing-fluid resources. Pressurization of the plug-forming agent frequently may be to a pressure greater than a determined maximum shut-in pressure within the wellbore. For multiple component systems, pressurization should be sufficient to facilitate any necessary mixing and/or pre-processing of the plug-forming agent components, in addition to maximum perceived introduction pressure in the wellbore. Pressurization may be facilitated by using at least one of a hydraulic or substantially incompressible fluid, a pneumatic fluid or compressible fluid, and/or a readily available fluid-source such as seawater, into the plug-forming agent reservoir or otherwise as the pressure source to pressurize the plug-forming agent reservoir and/or system. Cylinders or other containers or vessels may be used, including bag-type delivery systems such as commonly used on BOP accumulator systems.

Although the plug-forming agent introduction agent systems discussed herein are discussed with respect to subsea applications, it is understood that the terms and claimed subject matter contained herein is also applicable to non-subsea well control scenarios, including land wells and wells in shallow-water systems. The plug-forming agent introduction systems of this disclosure may be integrated as a common unit or split up into various locations according to the needs of a particular application. The systems may also be located in close proximity to a surface vessel, rig, platform, or other surface facility above a body of water. It is also understood that although discussions herein have pertained primarily to wellbore drilling applications, the claimed and disclosed processes and systems may also be applicable to production and or injection wellbore systems, or particularly pipeline systems. Pipeline system applications have the added convenience that system location can be widely selected and routinely positioned along the length of the pipeline, such as to create a pipeline plug in event of a major pipeline rupture or leak to mitigate the volume of spilled or leaked pipeline material. Such applications are considered within the scope of the disclosed and claimed subject matter.

As used herein, the term "and/or" placed between a first entity and a second entity means one of (1) the first entity, (2) the second entity, and (3) the first entity and the second entity. Multiple entities listed with "and/or" should be construed in the same manner, i.e., "one or more" of the entities so conjoined. Other entities may optionally be present other than the entities specifically identified by the "and/or" clause, whether related or unrelated to those entities specifically identified. Thus, as a non-limiting example, a reference to "A and/or B," when used in conjunction with open-ended language such as "comprising" may refer, in one embodiment, to A only (optionally including entities other than B); in another embodiment, to B only (optionally including entities other than A); in yet another embodiment, to both A and B (optionally including other entities). These entities may refer to elements, actions, structures, steps, operations, values, and the like.

As used herein, the phrase "at least one," in reference to a list of one or more entities should be understood to mean at least one entity selected from any one or more of the entity in the list of entities, but not necessarily including at least one of each and every entity specifically listed within the list of entities and not excluding any combinations of entities in the list of entities. This definition also allows that entities may optionally be present other than the entities specifically identified within the list of entities to which the phrase "at least one" refers, whether related or unrelated to those entities specifically identified. Thus, as a non-limiting example, "at least one of A and B" (or, equivalently, "at least one of A or B," or, equivalently "at least one of A and/or B") may refer, in one embodiment, to at least one, optionally including more than one, A, with no B present (and optionally including entities other than B); in another embodiment, to at least one, optionally including more than one, B, with no A present (and optionally including entities other than A); in yet another embodiment, to at least one, optionally including more than one, A, and at least one, optionally including more than one, B (and optionally including other entities). In other words, the phrases "at least one," "one or more," and "and/or" are open-ended expressions that are both conjunctive and disjunctive in operation. For example, each of the expressions "at least one of A, B, and C," "at least one of A, B, or C," "one or more of A, B, and C," "one or more of A, B, or C" and "A, B, and/or C" may mean A alone, B alone, C alone, A and B together, A and C together, B and C together, A, B and C together, and optionally any of the above in combination with at least one other entity.

The phrase "etc." is not limiting and is used herein merely for convenience to illustrate to the reader that the listed examples are not exhaustive and other members not listed may be included. However, absence of the phrase "etc." in a list of items or components does not mean that the provided list is exhaustive, such that the provided list still may include other members therein.

In the event that any patents, patent applications, or other references are incorporated by reference herein and (1) define a term in a manner that is inconsistent with and/or (2) are otherwise inconsistent with, either the non-incorporated portion of the present disclosure or any of the other incorporated references, the non-incorporated portion of the present disclosure shall control, and the term or incorporated disclosure therein shall only control with respect to the reference in which the term is defined and/or the incorporated disclosure was present originally.

As used herein the terms "adapted" and "configured" mean that the element, component, or other subject matter is designed and/or intended to perform a given function. Thus, the use of the terms "adapted" and "configured" should not be construed to mean that a given element, component, or other subject matter is simply "capable of" performing a given function but that the element, component, and/or other subject matter is specifically selected, created, implemented, utilized, programmed, and/or designed for the purpose of performing the function. It is also within the scope of the present disclosure that elements, components, and/or other recited subject matter that is recited as being adapted to perform a particular function may additionally or alternatively be described as being configured to perform that function, and vice versa.

As used herein, the phrase, "for example," the phrase, "as an example," and/or simply the term "example," when used with reference to one or more components, features, details, structures, embodiments, and/or methods according to the present disclosure, are intended to convey that the described component, feature, detail, structure, embodiment, and/or method is an illustrative, non-exclusive example of components, features, details, structures, embodiments, and/or methods according to the present disclosure. Thus, the described component, feature, detail, structure, embodiment, and/or method is not intended to be limiting, required, or exclusive/exhaustive; and other components, features, details, structures, embodiments, and/or methods, including structurally and/or functionally similar and/or equivalent components, features, details, structures, embodiments, and/or methods, are also within the scope of the present disclosure.

INDUSTRIAL APPLICABILITY

The systems and methods disclosed herein are applicable to the oil and gas industries.

It is believed that the disclosure set forth above encompasses multiple distinct inventions with independent utility. While each of these inventions has been disclosed in its preferred form, the specific embodiments thereof as disclosed and illustrated herein are not to be considered in a limiting sense as numerous variations are possible. The subject matter of the inventions includes all novel and non-obvious combinations and subcombinations of the various elements, features, functions and/or properties disclosed herein. Similarly, where the claims recite "a" or "a first" element or the equivalent thereof, such claims should be understood to include incorporation of one or more such elements, neither requiring nor excluding two or more such elements.

It is believed that the following claims particularly point out certain combinations and subcombinations that are directed to one of the disclosed inventions and are novel and non-obvious. Inventions embodied in other combinations and subcombinations of features, functions, elements and/or properties may be claimed through amendment of the present claims or presentation of new claims in this or a related application. Such amended or new claims, whether they are directed to a different invention or directed to the same invention, whether different, broader, narrower, or equal in scope to the original claims, are also regarded as included within the subject matter of the inventions of the present disclosure.

The invention claimed is:

1. A method of performing a wellbore intervention operation to reduce an uncontrolled flow of wellbore blowout fluid from a subterranean wellbore, the method comprising:

providing a first plug-forming agent reservoir comprising a first plug-forming agent proximate a wellbore, the first plug-forming agent reservoir in selective fluid communication with the wellbore at a first plug-forming agent introduction port; and providing a first pressure source capable of pressurizing the first plug-forming agent reservoir containing the first plug-forming agent to a first-agent delivery pressure;

providing a weighted fluid introduction port for introducing a weighted fluid into the wellbore throughbore upstream of the first plug-forming agent introduction port with respect to the direction of flow of the wellbore blowout fluid within the wellbore;

providing the weighted fluid in selective fluid communication with the weighted fluid introduction port, the weighted fluid having a fluid density sufficient to exert a hydrostatic bottom hole pressure within the wellbore greater than the bottom hole pressure in the subterranean wellbore when the wellbore is filled with the weighted fluid;

introducing the first plug-forming agent through the first plug-forming agent introduction port and forming a plug within the wellbore at or above the first plug-forming agent introduction port; and thereafter, introducing the weighted fluid into the wellbore throughbore upstream of the first plug-forming agent introduction port with respect to the direction of flow of the wellbore blowout fluid until the introduced weighted fluid exerts a hydrostatic bottom hole pressure within the wellbore that is greater than or equal to the bottom hole pressure in the wellbore when the wellbore is filled with the weighted fluid and the weighted fluid is not exerting hydrostatic pressure within the wellbore on the plug, such that the weighted fluid within the wellbore alone kills the well without relying upon the plug.

2. The method of claim 1, further comprising thereafter drilling out the plug.

3. The method of claim 1, further comprising mixing the first plug-forming agent with a wellbore blowout fluid to form the flow-restricting plug within the wellbore.

4. The method of claim 1, further comprising:

providing a second plug-forming agent reservoir comprising a second plug-forming agent proximate the wellbore, the second plug-forming agent reservoir in selective fluid communication with the wellbore and the first plug-forming agent; and providing a second pressure source capable of pressurizing the second plug-forming agent reservoir comprising the second plug-forming agent to a second-agent delivery pressure.

5. The method of claim 4, further comprising selectively introducing the pressurized second plug-forming agent into mixing engagement with the first plug-forming agent to form the flow-restricting plug within the wellbore.

6. The method of claim 5, further comprising introducing the second plug-forming agent into mixing engagement with the first plug-forming agent to form a pre-mixed plug-forming agent and introducing the premixed plug-forming agent into the wellbore to form the flow-restricting plug within the wellbore.

7. The method of claim 6, further comprising introducing the second plug-forming agent into mixing engagement with the first plug-forming agent in a mixing chamber to form the premixed plug-forming agent.

8. The method of claim 5, further comprising simultaneously introducing the first plug-forming agent and the second plug forming agents into the wellbore to cause mixing of the first plug-forming agent and second plug-forming agent within the wellbore to form the flow-restricting plug within the wellbore.

9. The method of claim 1, wherein the step of pressurizing the first plug-forming agent reservoir comprises at least one of (1) pre-pressurizing the first plug-forming agent reservoir in a stand-by readiness state prior to selectively introducing the first plug-forming agent into the wellbore, (2) connecting the first-plug forming agent reservoir with a proximately located and selectively actuatable pressurization system, and (3) connecting the first plug-forming agent reservoir with a distributed and selectively actuated pressurization system.

10. The method of claim 4, wherein the step of pressurizing the second plug-forming agent reservoir comprises at least one of (1) pre-pressurizing the second plug-forming agent reservoir in a stand-by readiness state prior to selectively introducing the second plug-forming agent into the wellbore, (2) connecting the second-plug forming agent reservoir with a proximately located and selectively actuatable pressurization system, and (3) connecting the second plug-forming agent reservoir with a distributed and selectively actuated pressurization system.

11. The method of claim 1, further comprising locating the first plug-forming agent reservoir on or proximately near a seafloor.

12. The method of claim 4, further comprising locating the second plug-forming agent reservoir on or proximately near a seafloor.

13. The method of claim 1, further comprising providing a compressible fluid as the first pressure source to pressurize the first plug-forming agent reservoir.

14. The method of claim 1, further comprising pumping at least one of a hydraulic fluid, a pneumatic fluid, and seawater into the first plug-forming agent reservoir as the first pressure source to pressurize the first plug-forming agent reservoir.

15. The method of claim 4, further comprising providing a compressible fluid as the second pressure source to pressurize the second plug-forming agent reservoir.

16. The method of claim 4, further comprising pumping at least one of a hydraulic fluid and a pneumatic fluid into the second plug-forming agent reservoir as the second pressure source to pressurize the second plug-forming agent reservoir.

17. The method of claim 1, further comprising selectively introducing at least one of the first plug-forming agent and a second plug-forming agent into the wellbore throughbore while the wellbore blowout fluid flows from the subterranean formation through the wellbore throughbore at a wellbore blowout fluid flow rate, to create a an impeding or plugging barrier to flow of the wellbore blowout fluid through the wellbore throughbore.

18. The method of claim 1, further comprising:

providing a flow control device engaged proximate a top end of a wellbore conduit, the flow control device including a primary throughbore coaxially aligned with and comprising a portion of the wellbore throughbore; and introducing the at least one of the first plug-forming agent and a second plug-forming agent into the wellbore throughbore within or upstream of the flow control device, with respect to the direction of flow of the wellbore blowout fluid.

19. The method of claim 1, comprising providing at least one of a polymerizable monomer and a polymer as the first plug-forming agent; and at least one of polymerizing and crosslinking the plug-forming agent within the wellbore throughbore to create a barrier to flow of the wellbore blowout fluid through the wellbore throughbore.

20. The method of claim 1, further comprising providing at least one of a polymerizable polymer or monomer, a crosslinkable polymer, an activatable resin, and fibrous media as the first plug-forming agent.

21. The method of claim 4, further comprising providing at least one of a polymerization catalyst, a crosslinking agent, and a resin-forming catalyst as the second plug forming agent.

22. The method of claim 1, further comprising crosslinking at least one of the first plug-forming agent and another plug-forming agent within the wellbore throughbore.

23. The method of claim 1, further comprising mixing water and the first plug-forming agent within the wellbore throughbore to activate at least one of crosslinking or polymerization of the first plug-forming agent.

24. The method of claim 1, wherein providing the first plug-forming agent comprises providing a dicyclopentadiene (DCPD).

25. The method of claim 1, wherein providing the first plug-forming agent comprises providing a siloxane.

26. The method of claim 1, further comprising:

a flow control device engaged proximate a top end of a wellbore conduit, the flow control device including a primary throughbore coaxially aligned with and comprising a portion of the wellbore throughbore.

27. A system for performing a wellbore intervention operation to reduce an uncontrolled flow rate of wellbore fluids from a subterranean wellbore, the system comprising:

a first plug-forming agent reservoir comprising a first plug-forming agent proximate a wellbore, the first plug-forming agent reservoir selectively in fluid communication with the wellbore and the first plug-forming agent selectively introducible into the wellbore;

a first plug-forming agent introduction port capable for communicating the first plug-forming agent reservoir with the wellbore;

a first pressure source capable of pressurizing the first plug-forming agent reservoir containing the first plug-forming agent to a first-agent delivery pressure capable to selectively introduce the first plug-forming agent into the wellbore through the first plug-forming agent introduction port and capable of introducing the first plug-forming agent through the first plug-forming agent introduction port and forming a plug within the wellbore at or above the first plug-forming agent introduction port;

a weighted fluid introduction port upstream of the first plug-forming agent introduction port with respect to the direction of flow of the wellbore blowout fluid capable for introducing a weighted fluid into the wellbore throughbore upstream of the first plug-forming agent introduction port; and a weighted fluid source capable for providing the weighted fluid in selective fluid communication with the weighted fluid introduction port subsequent to formation of the plug within the wellbore by the first plug-forming agent, the weighted fluid having a fluid density sufficient to exert a hydrostatic bottom hole pressure within the wellbore greater than or equal to the bottom hole pressure in the subterranean wellbore when the wellbore is filled with the weighted fluid and the weighted fluid is not exerting hydrostatic pressure within the wellbore on the plug, such that the weighted fluid within the wellbore alone kills the well without relying upon the plug.

28. The system of claim 27, further comprising:

a second plug-forming agent reservoir comprising a second plug-forming agent proximate the wellbore, the second plug-forming agent reservoir selectively in fluid communication with the wellbore and the first plug-forming agent; and providing a second pressure source capable of pressurizing the second plug-forming agent reservoir comprising the second plug-forming agent to a second-agent delivery pressure capable to selectively introduce the second plug-forming agent into at least one of the wellbore and the first plug forming agent.

29. The system of claim 28, further comprising a mixing chamber capable for receiving and mixing the second plug-forming agent into mixing engagement with the first plug-forming agent to form a premixed plug-forming agent.

30. The system of claim 27, further comprising an actuator capable to selectively introduce the first plug-forming agent and optionally a second plug-forming agent, into the wellbore.

31. The system of claim 27, further comprising a pump capable to selectively pressurize at least one of the first plug-forming agent reservoir and optionally a second plug-forming agent reservoir.

32. The system of claim 27, further comprising an accumulator assembly including pressurized containers.

* * * * *